US005632446A

United States Patent [19]

Krochek

[11] Patent Number: 5,632,446

[45] Date of Patent: May 27, 1997

[54] SHUT OFF IN SHOWER APPARATUS

[75] Inventor: Artur Krochek, Tel Aviv, Israel

[73] Assignee: Unitrol Amcor Ltd., Rehovot, Israel

[21] Appl. No.: 487,415

[22] Filed: Jun. 7, 1995

[30] Foreign Application Priority Data

Aug. 14, 1994 [IL] Israel ..... 110656

[51] Int. Cl.[6] ..... B05B 3/04

[52] U.S. Cl. ..... 239/381; 239/443; 239/464

[58] Field of Search ..... 239/381, 383, 239/539, 541, 436, 442, 443, 445–7, 463, 464

[56] References Cited

U.S. PATENT DOCUMENTS

| | | | |
|---|---|---|---|
| 4,561,593 | 12/1985 | Cammack et al. | 239/443 |
| 4,598,866 | 7/1986 | Cammack et al. | 239/447 |
| 5,102,095 | 4/1992 | Schmitt-Matzen et al. | 251/117 |
| 5,356,077 | 10/1994 | Shames et al. | 239/383 |
| 5,518,181 | 5/1996 | Shames et al. | 239/381 |

FOREIGN PATENT DOCUMENTS

| | | |
|---|---|---|
| 590616 | 1/1934 | Germany . |
| 3903800 | 8/1990 | Germany . |

OTHER PUBLICATIONS

Derwent Abstract: DE 3903800, WPI Acc No. 90–254807/34.

English Translation of Patent Claim DE590616.

*Primary Examiner*—Andres Kashnikow
*Assistant Examiner*—Lisa Ann Douglas
*Attorney, Agent, or Firm*—Ladas & Parry

[57] ABSTRACT

Shower apparatus including a valve having an aperture, a first packing preform mounted on the valve, located downstream of the valve, and a stemmed element selectably movable with respect to the valve aperture and operative to selectably press the first packing preform against the valve, thereby substantially sealing the valve aperture.

2 Claims, 6 Drawing Sheets

FIG. 1

SHUT OFF IN SHOWER APPARATUS

FIELD OF THE INVENTION

The present invention relates to shower apparatus.

BACKGROUND OF THE INVENTION

Shower apparatus is a well known device which directs the flow of water from a water supply to a bather, such that the manner, rate, intensity and direction of flow are controllable by the bather. For example, shower apparatus is known which causes a pulsating flow of water; another causes the water flow to be aerated. Shower apparatus is known which is capable of providing a variety of flows which the user can choose. The apparatus may be rigidly mounted or hand-held.

Normally, shower apparatus is fluidly connected to a water supply, and valves or controls external to and independent of shower apparatus, such as faucet handles, provide or cease flow of water to apparatus. Shower apparatus are known which have an internal mechanism, called a shut-off valve, which the bather can use to cease and/or provide the flow of water to the shower apparatus, thereby obviating the need of readjusting the external controls. This is particularly desirable in most plumbing installations in which the faucet handles not only determine the flow of water, but the temperature as well. Since a shower does not require constant water flow, such as during application of soap, the internal shut-off valve allows the bather to conserve water without the need of readjusting the faucet handles for temperature control.

Generally shut-off valves of the prior art include a plurality of movable parts which inherently increase manufacturing costs and decrease reliability.

SUMMARY OF THE INVENTION

The present invention seeks to provide a simple, reliable and inexpensive shower head, including a shut-off valve, which may provide a variety of flows, such as spray, pulsed or aerated.

There is thus provided in accordance with a preferred embodiment of the present invention shower apparatus including a valve having an aperture, a first packing preform mounted on the valve, located downstream of the valve, and a stemmed element selectably movable with respect to the valve aperture and operative to selectably press the first packing preform against the valve, thereby substantially sealing the valve aperture.

Additionally in accordance with a preferred embodiment of the present invention, the valve further comprises a second packing preform located downstream of the first packing preform, the stemmed element being in selectable sealing engagement with the second packing preform.

Further in accordance with a preferred embodiment of the present invention, the stemmed element further comprises a packing preform, such that a movement of the stemmed element selectively brings the stemmed element packing preform into substantially sealed engagement with a portion of the shower apparatus.

There is also provided in accordance with a preferred embodiment of the present invention, shower apparatus including a valve having an aperture, a first packing preform mounted on the valve, located downstream of the valve aperture, a second packing preform mounted on the valve and located downstream of the first packing preform, and a stemmed element selectably movable with respect to the valve aperture, the stemmed element being in selectable sealing engagement with the second packing preform, and the stemmed element being operative to selectably press the first packing preform against the valve, thereby substantially sealing the valve, the stemmed element comprising a packing preform, such that a movement of the stemmed element selectively brings the stemmed element packing preform into substantially sealed engagement with a portion of the shower apparatus.

Additionally in accordance with a preferred embodiment of the present invention, shower apparatus includes a turbine and at least one exit aperture, such that suitable movement of the stemmed element with respect to the valve brings the first packing preform into non-sealed engagement with the valve aperture, the second packing preform into non-sealed engagement with the stemmed element, and the stemmed element packing preform into substantially sealed engagement with the portion of the shower apparatus, such that a flow of water through the shower apparatus is directed to the turbine causing rotation thereof, the flow of water exiting through the at least one exit aperture.

Additionally, or alternatively, in accordance with a preferred embodiment of the present invention, shower apparatus also includes a spreader element and at least one exit aperture, such that suitable movement of the stemmed element with respect to the valve brings the first packing preform into non-sealed engagement with the valve, the second packing preform into substantially sealed engagement with the stemmed element, and the stemmed element packing preform into non-sealed engagement with the portion of the shower apparatus, such that a flow of water through the shower apparatus is directed to the spreader element, the flow of water exiting through the at least one exit aperture.

BRIEF DESCRIPTION OF THE DRAWINGS

The present invention will be understood and appreciated from the following detailed description, taken in conjunction with the drawings in which.

DETAILED DESCRIPTION OF PREFERRED EMBODIMENTS

Figure 1:
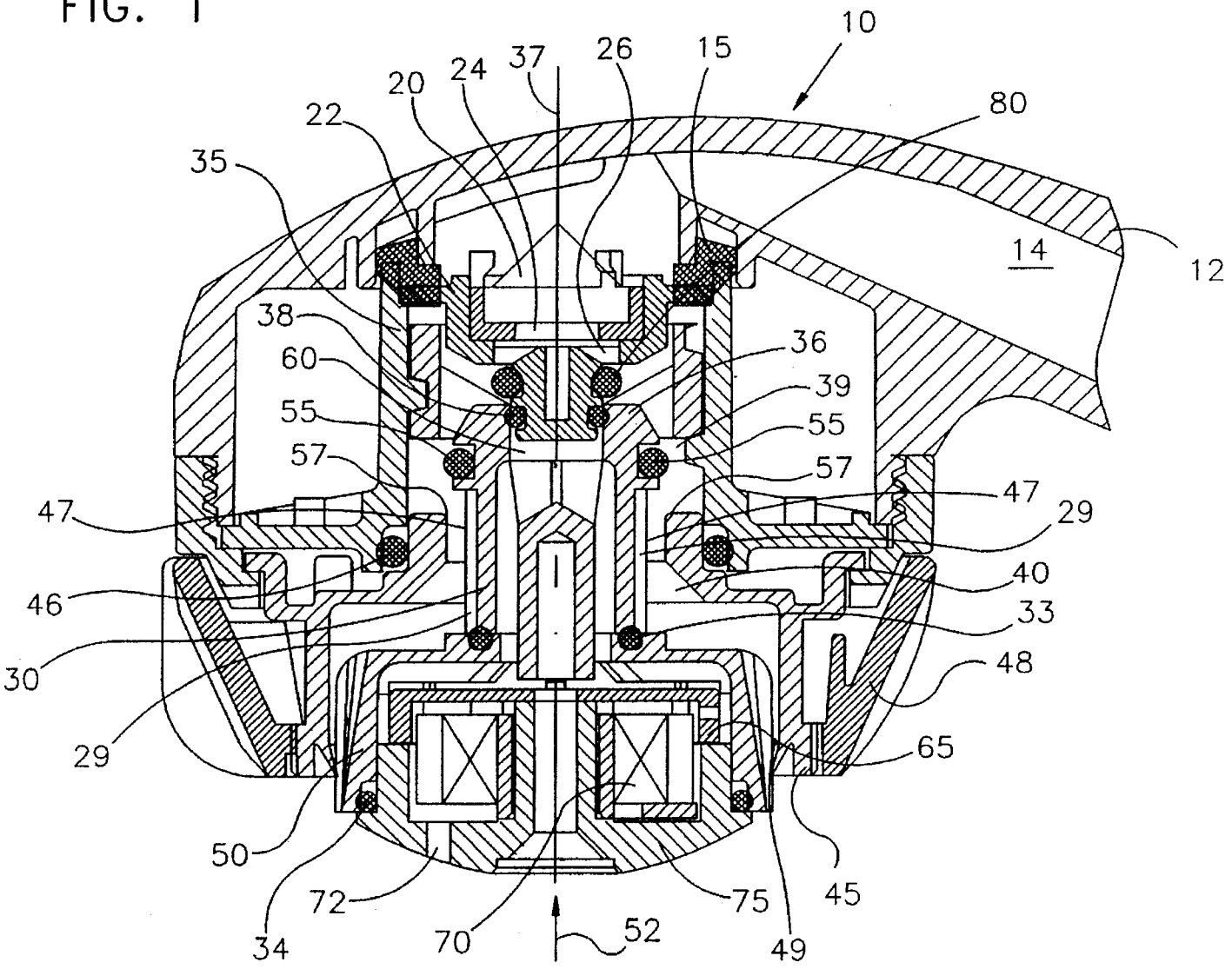
FIG. 1 is a simplified sectional illustration of shower apparatus constructed and operative in accordance with a preferred embodiment of the present invention, shower apparatus being oriented to provide a spray flow of water.
Figure 2:
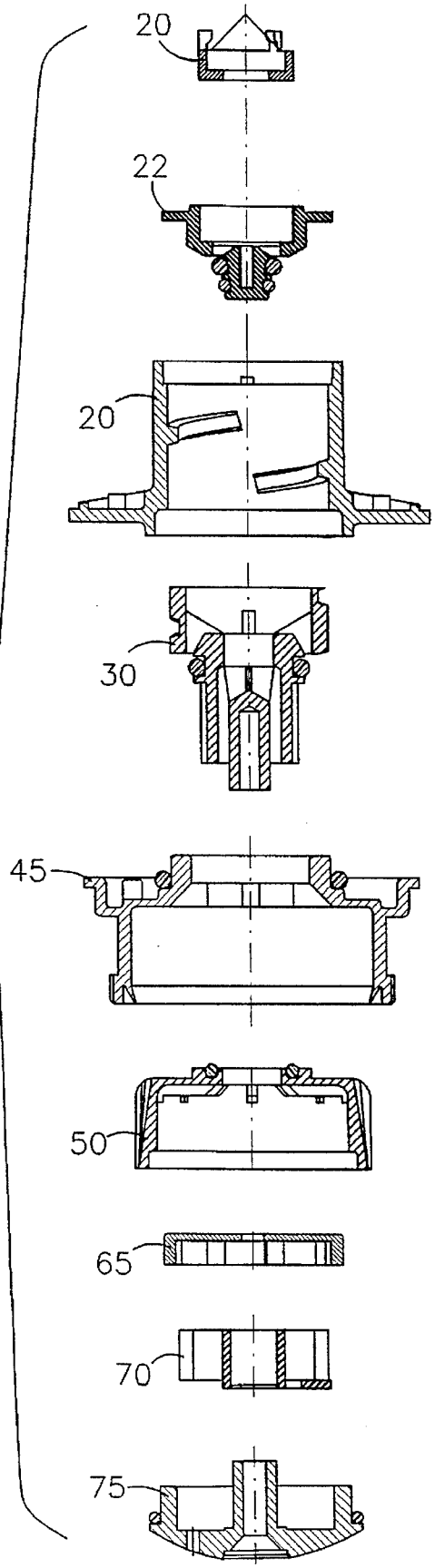
FIG. 2 is a simplified exploded sectional illustration of the shower apparatus shown in FIG. 1.

Reference is now made to FIGS. 1 and 2 which illustrate a shower apparatus 10 constructed and operative in accordance with a preferred embodiment of the present invention. Shower apparatus 10 may be hand-held or may be provided with a fitting for mounting in a shower stall.

Shower apparatus 10 includes a housing 12 with a water inlet 14 which directs flow of water from a water supply (not shown) towards a flow regulator 20 which is seated in a shut-off valve 22. Downstream of shut-off valve 22 is located a stemmed element 30 which threadably engages with a threaded base 35. Threaded base 35 is rigidly mounted to housing 12 and is substantially sealed with housing 12 preferably by means of a seal 15. Seal 15 also rigidly seals shut-off valve 22 from housing 12, as seen in FIG. 1.

Housing 12, flow regulator 20, shut-off valve 22, threaded base 35 and seal 15 thus form a non-rotating assembly. Stemmed element 30, by virtue of its threaded engagement with threaded base 35, may be moved linearly with respect to this non-rotating assembly as is described hereinbelow.

Stemmed element 30 is rigidly attached to a spreader element 50 which is fixedly attached to a face plate 75. Preferably a packing preform 33 substantially seals stemmed element 30 from spreader element 50 and a packing preform 34 substantially seals spreader element 50 from face plate 75. Stemmed element 30, face plate 75 and spreader element 50 all may be rotated together about a common axis 37, and moved together linearly along axis 37.

Stemmed element 30 is rotated by means of a rotator 45. Rotator 45 is rotatably sealed with respect to threaded base 35 by means of a packing preform 46. Rotator 45 is rigidly attached to an outer ring 48.

Inner teeth 47 of rotator 45 engage with a splined portion 29 of stemmed element 30, as seen in FIG. 1. In order to move stemmed element 30 linearly with respect to threaded base 35 and shut-off valve 22, a user rotates outer ring 48, thereby rotating rotator 45. Teeth 47 of rotator 45 mesh with splined portion 29 of stemmed element 30, thereby imparting a rotating motion thereto. As stemmed element 30 rotates, it threads with threaded base 35 and moves, linearly with respect thereto.

For example, by turning ring 48 and rotator 45 clockwise as viewed along an arrow 52 in FIG. 1, stemmed element 30 is caused to be moved in direction of arrow 52. By turning ring 48 and rotator 45 counterclockwise as viewed in the direction of arrow 52, stemmed element 30 is caused to be moved in a direction opposite to arrow 52. Thus, stemmed element 30, spreader element 50 and face plate 75 together may be moved linearly along axis 37 by rotation of ring 48 and rotator 45. Ring 48 and rotator 45 only rotate about axis 37; they do not move in a generally linear direction.

Returning to a description of the water flow, it is seen that in the configuration illustrated in FIG. 1 water flows through an aperture 24 of flow regulator 20 towards an aperture 26 of shut-off valve 22. As seen in FIG. 1, shut-off valve 22 is provided with a packing preform 80, located near aperture 26, and another packing preform 38 downstream of packing preform 80.

In the configuration illustrated in FIG. 1, packing preform 80 does not seal aperture 26, but packing preform 38 does substantially seal water from flowing into an aperture 60 of a throat 36 of stemmed element 30. Water is thus constricted to flow from aperture 26 through a passageway 39 created between stemmed element 30 and an inner wall of base 35. Water continues to flow through passageway 40 near the engagement of teeth 47 of rotator 45 and splined portion 29 of stemmed element 30, on to constricted spaces 49 between rotator 45 and spreader element 50. Water exits constricted spaces 49 in the form of a spray.

Figure 3:
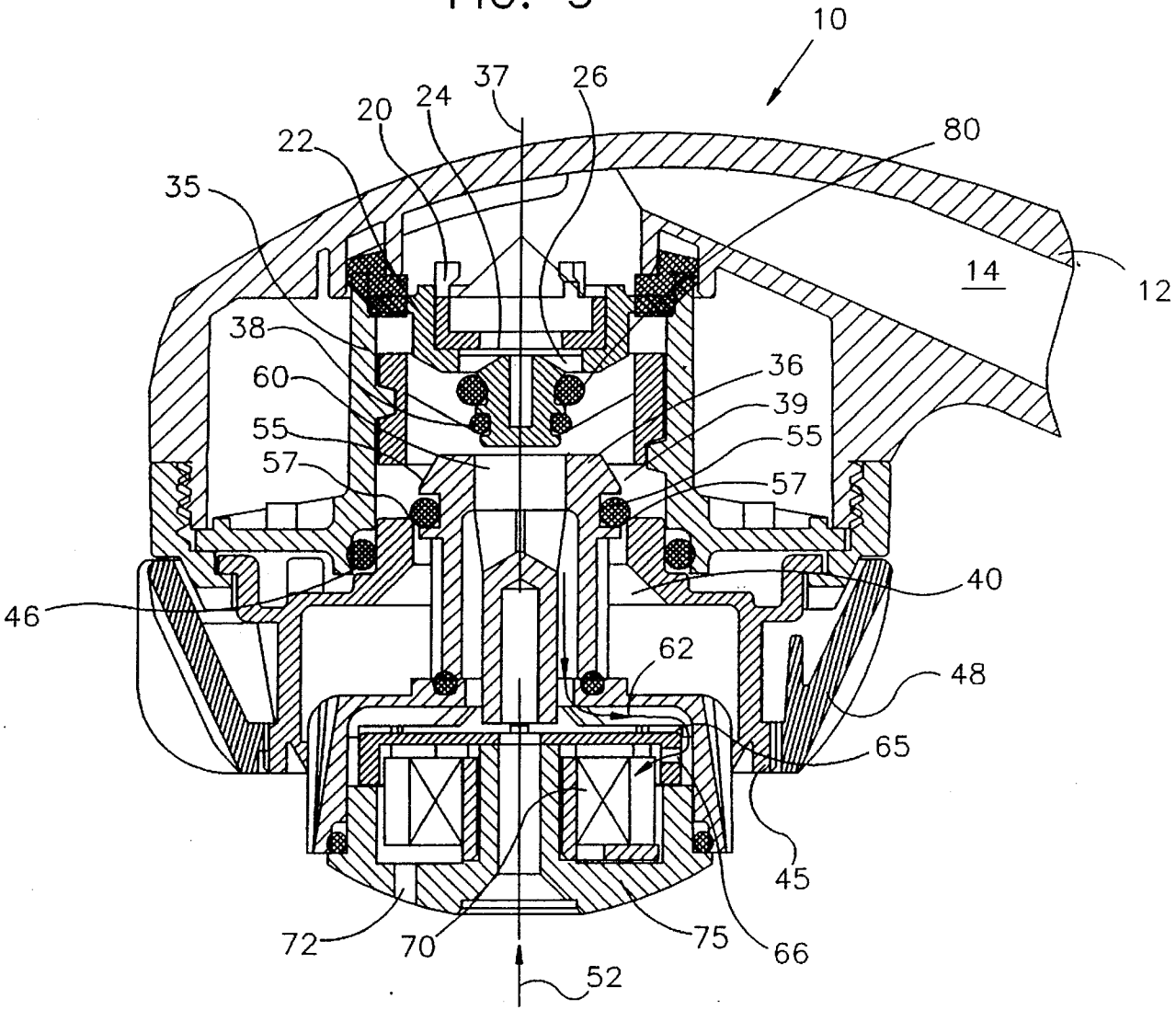
FIG. 3 is a simplified sectional illustration of the shower apparatus of FIG. 1 oriented to provide a pulsating type of water flow.

Reference is now made to FIG. 3, in which shower apparatus 10 is oriented to provide a pulsating flow of water, such as for purposes of a massage. Rotation of ring 48 and rotator 45 counterclockwise as viewed in the direction of reference arrow 52, causes stemmed element 30 to move in a direction opposite to arrow 52 and causes packing preform 55 of stemmed element 30 to be sealably seated against a shoulder 57 of rotator 45. Simultaneously, stemmed element 30 is brought out of sealed engagement with packing preform 38. Once stemmed element 30 is sealably seated against rotator 45, water can no longer flow to passageway 40, but rather is forced to flow through aperture 60 of throat 36 of stemmed element 30.

Water then continues to flow through stemmed element 30 in the direction of an arrow 62 to a diffuser element 65 which distributes the water flow via an aperture 66 to a turbine 70. Water flows from turbine 70 via at least one aperture 72 in face plate 75. Water is thus intermittently dispersed through the at least one aperture 72 by the rotation of turbine 70, effecting a pulsating flow.

Figure 4:
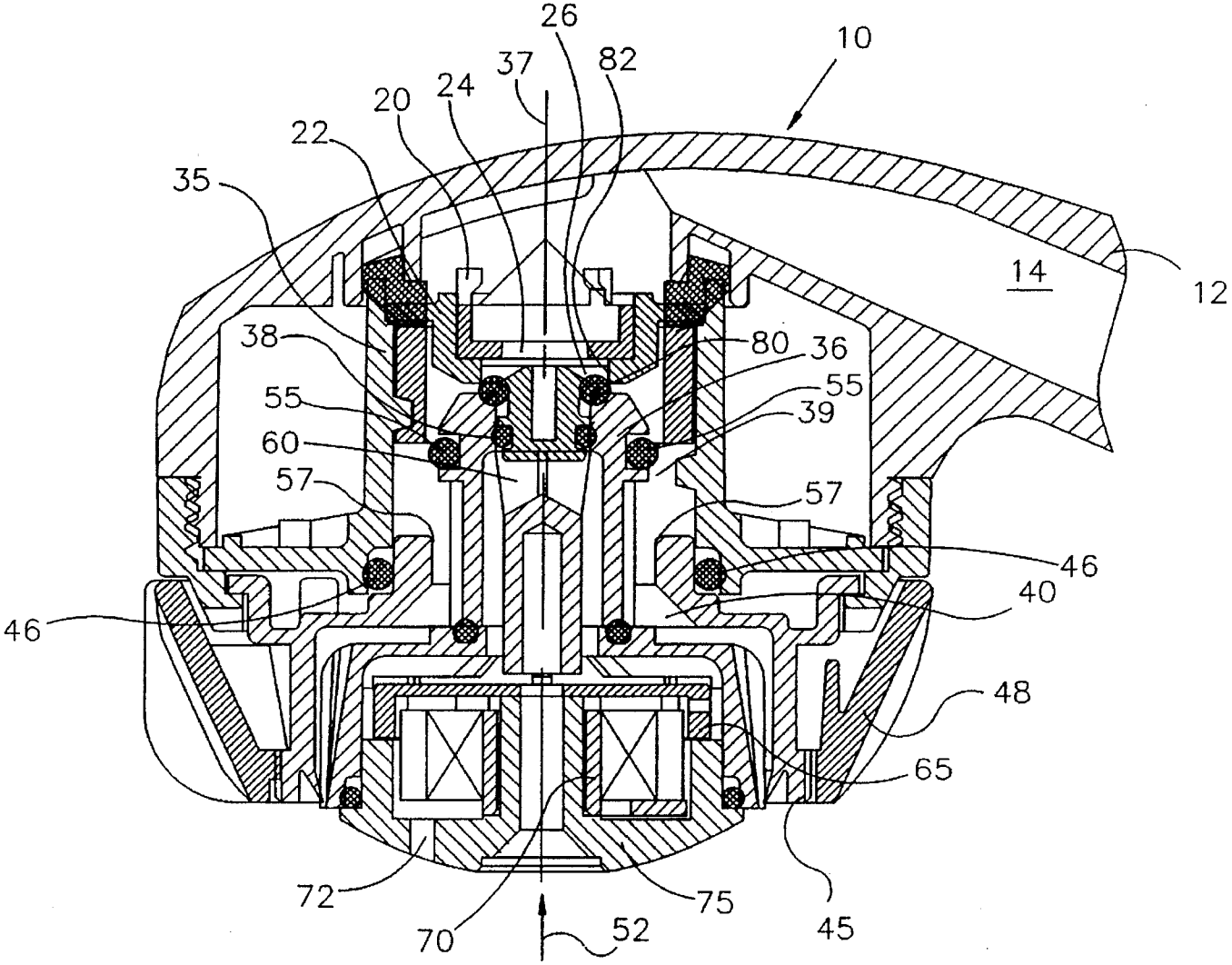
FIG. 4 is a simplified sectional illustration of the shower apparatus of FIG. 1 oriented to be shut off.

Reference is now made to FIG. 4, in which shower apparatus 10 is oriented to be shut-off. As viewed along the direction of arrow 52, clockwise rotation of ring 48 and rotator 45 causes stemmed element 30 to move in the direction of arrow 52. An upper face of throat 36 of stemmed element 30 is forced against packing preform 80 of shut-off valve 22. Packing preform 80 is forced to butt against an edge 82 of shut-off valve 22, thereby sealing aperture 26. The water flow is now prevented from reaching both passageway 39 associated with spray flow, and aperture 60 associated with pulsating flow, thereby achieving a complete "shut-off" of water.

It is appreciated that spray flow described with reference to FIG. 1 and pulsed flow described with reference to FIG. 3, are only examples of types of flow which shower head 10 may be constructed to provide. By adding suitable, conventional hardware of the art, shower head 10 may be constructed to provide other types of flow as well, such as an aerated flow.

Figure 5:
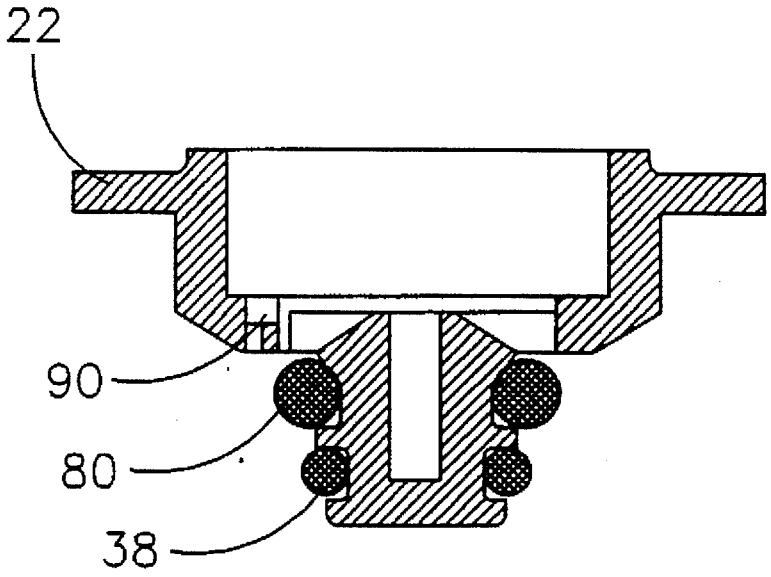
FIG. 5 is a sectional detailed illustration of a shut-off valve of the shower apparatus of FIG. 1.

Reference is now additionally made to FIG. 5. Many municipal plumbing codes and regulations require that a shut-off device in shower apparatus shall not completely shut off water flow, but rather shall deliberately allow a trickle of water to remain. In order to meet the specifications of such codes, shut-off valve 22 is provided with a small aperture 90 as shown in FIG. 5. Even if packing preform 80 is sealably seated against edge 82 of valve 22 (FIG. 4), water will still trickle through aperture 90 and then through passageways 39, 40 and 49 to exit shower apparatus 10.

Figure 6:
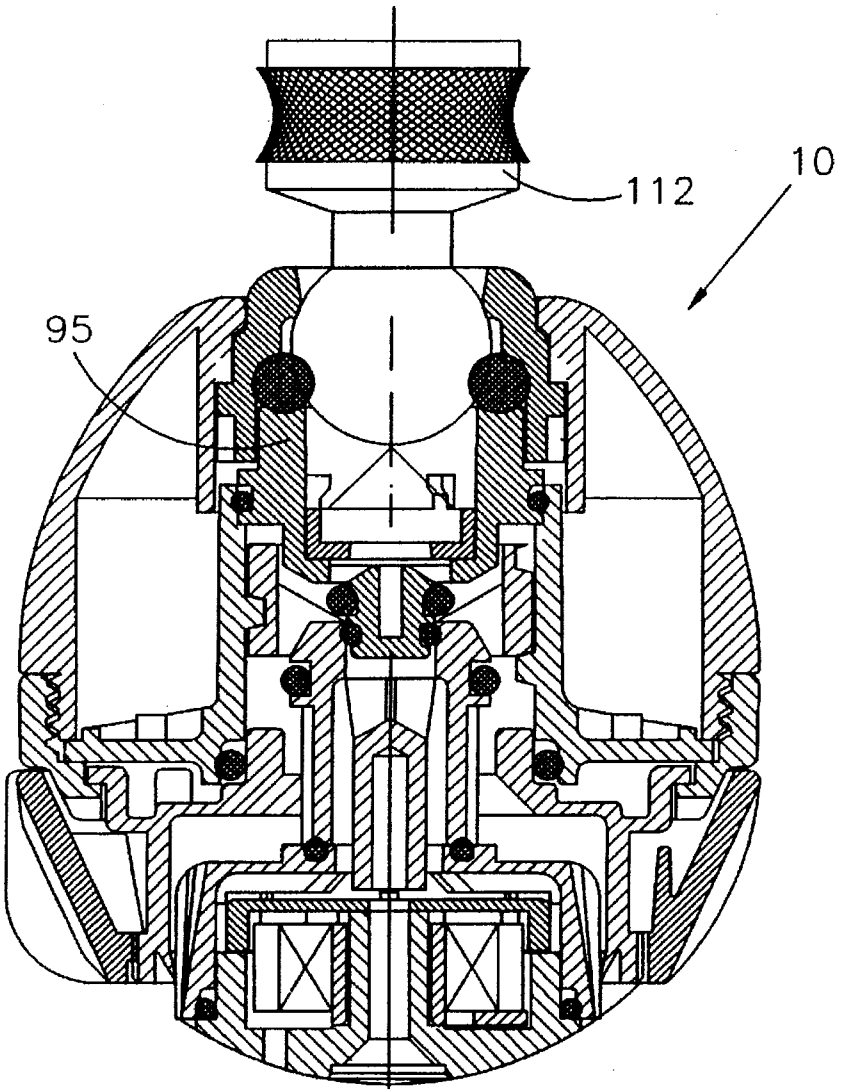
FIG. 6 is a sectional illustration of a shower apparatus constructed and operative in accordance with another preferred embodiment of the present invention.

Reference is now made to FIG. 6 which illustrates shower apparatus 110 constructed and operative according to another preferred embodiment of the present invention. In this embodiment, shower apparatus 110 is provided with a fitting 112 preferably for mounting to a wall or ceiling. The shut-off mechanism of apparatus 110 is the same as described hereinabove for apparatus 10, except that a valve 95 replaces valve 22 to fit the different configuration of apparatus 110.

It will be appreciated by persons skilled in the art that the present invention is not limited to what has been particularly shown and described hereinabove. Rather, the scope of the present invention is defined only by the claims that follow:

What is claimed is:

1. Shower apparatus comprising:

a valve having an aperture;

a first packing preform mounted on said valve, located downstream of said valve aperture;

a second packing preform mounted on said valve and located downstream of said first packing preform; and a stemmed element selectably movable with respect to said valve aperture, said stemmed element being in selectable sealing engagement with said second packing preform, and said stemmed element being operative to selectably press said first packing preform against said valve, thereby substantially sealing said valve aperture;

wherein said stemmed element comprises a packing preform, such that a movement of said stemmed element selectively brings said stemmed element packing preform into substantially sealed engagement with a portion of said shower apparatus, and comprising a turbine and at least one exit aperture, such that suitable movement of said stemmed element with respect to said valve brings said first packing preform into non-sealed engagement with said valve aperture, said second packing preform into non-sealed engagement with said stemmed element, and said stemmed element packing preform into substantially sealed engagement with said portion of said shower apparatus, such that a flow of water through said shower apparatus is directed to said turbine causing rotation thereof, said flow of water exiting through said at least one exit aperture.

2. Shower apparatus comprising:

a valve having an aperture;

a first packing preform mounted on said valve, located downstream of said valve aperture;

a second packing preform mounted on said valve and located downstream of said first packing preform; and a stemmed element selectably movable with respect to said valve aperture, said stemmed element being in selectable sealing engagement with said second packing preform, and said stemmed element being operative to selectably press said first packing preform against said valve, thereby substantially sealing said valve aperture;

wherein said stemmed element comprises a packing preform, such that a movement of said stemmed element selectively brings said stemmed element packing preform into substantially sealed engagement with a portion of said shower apparatus, and comprising a spreader element and at least one exit aperture, such that suitable movement of said stemmed element with respect to said valve brings said first packing preform into non-sealed engagement with said valve, said second packing preform into substantially sealed engagement with said stemmed element, and said stemmed element packing preform into non-sealed engagement with said portion of said shower apparatus, such that a flow of water through said shower apparatus is directed to said spreader element, said flow of water exiting through said at least one exit aperture.

* * * * *